US010760862B2

(12) United States Patent
Daniel et al.

(10) Patent No.: US 10,760,862 B2
(45) Date of Patent: Sep. 1, 2020

(54) BOLT STOP ASSEMBLIES

(71) Applicant: Daniel Defense, Inc., Black Creek, GA (US)

(72) Inventors: Marvin C. Daniel, Pooler, GA (US); Daniel McLeroy, Savannah, GA (US); Luke South, Lexington, KY (US)

(73) Assignee: DANIEL DEFENSE, INC., Black Creek, GA (US)

( * ) Notice: Subject to any disclaimer, the term of this patent is extended or adjusted under 35 U.S.C. 154(b) by 0 days.

(21) Appl. No.: 16/596,182

(22) Filed: Oct. 8, 2019

(65) Prior Publication Data

US 2020/0109904 A1 Apr. 9, 2020

Related U.S. Application Data

(60) Provisional application No. 62/743,316, filed on Oct. 9, 2018.

(51) Int. Cl.
*F41A 3/68* (2006.01)
*F41A 3/66* (2006.01)

(52) U.S. Cl.
CPC . *F41A 3/68* (2013.01); *F41A 3/66* (2013.01)

(58) Field of Classification Search
CPC ..... F41A 3/66; F41A 3/68; F41A 3/42; F41A 3/38; F41A 3/36
USPC ..... 89/180, 181, 190
See application file for complete search history.

(56) References Cited

U.S. PATENT DOCUMENTS 694,156 A * 2/1902 Johnson ..... F41A 3/66 42/75.03
1,860,157 A * 5/1932 Payne ..... F41A 3/26 89/138
2,373,141 A * 4/1945 Orloff ..... F41A 11/00 42/108
2,601,808 A * 7/1952 Clarke ..... F41A 3/40 89/190
2,912,779 A * 11/1959 Catlin ..... F41A 15/16 42/25
3,098,311 A * 7/1963 Savioli ..... F41A 17/36 42/18
3,198,075 A * 8/1965 Maillard ..... F41A 17/40 89/33.2
3,621,598 A * 11/1971 Ruger et al. ..... F41A 3/68 42/16
3,835,566 A * 9/1974 Bielfeldt ..... F41A 3/42 42/16
3,979,849 A * 9/1976 Haskins ..... F41A 3/22 42/16

(Continued)

*Primary Examiner* — Derrick R Morgan
(74) *Attorney, Agent, or Firm* — Eversheds Sutherland (US) LLP

(57) ABSTRACT

A bolt stop assembly is disclosed herein. The bolt stop assembly may include a receiver and a bolt. The receiver may include a plurality of channels extending longitudinally to a firearm barrel. The bolt may include a series of lugs on a distal end of the bolt configured to traverse the plurality of channels. The bolt stop assembly may include an aperture adjacent to the breech end of the receiver, and an actuating bolt stop set within the aperture. The actuating bolt stop actuates around a pivot pin within a pin hole set parallel to a longitudinal axis. The actuating bolt stop may include an interior surface where a biasing member is disposed between the interior surface and the receiver.

12 Claims, 15 Drawing Sheets

(56) References Cited

U.S. PATENT DOCUMENTS 3,996,684 A * 12/1976 Bauman ..... F41A 3/26 42/16
4,058,922 A * 11/1977 Elbe ..... F41A 9/71 42/16
4,445,292 A * 5/1984 Martin ..... F41A 3/38 42/16
7,661,219 B1 * 2/2010 Knight, Jr. ..... F41A 35/06 42/70.02
7,681,483 B1 * 3/2010 Rhoades ..... F41A 33/00 89/29
7,950,177 B2 * 5/2011 Laney ..... F41A 17/46 42/14
7,975,417 B2 * 7/2011 Duplessis ..... F41A 3/30 42/16
8,782,939 B2 * 7/2014 Constant ..... F41A 21/482 42/69.01
9,551,545 B1 * 1/2017 Rowe ..... F41A 35/00
10,514,219 B2 * 12/2019 Schafer ..... F41A 3/22
2005/0183310 A1 * 8/2005 Finn ..... F41A 17/38 42/49.01
2005/0229456 A1 * 10/2005 McGarry ..... F41A 9/53 42/1.01
2010/0175290 A1 * 7/2010 Duplessis ..... F41A 21/482 42/16
2010/0281733 A1 * 11/2010 Constant ..... F41A 3/66 42/16
2012/0167424 A1 * 7/2012 Gomez ..... F41A 35/06 42/14
2015/0323271 A1 * 11/2015 McGinty ..... F41A 3/72 42/17
2016/0282070 A1 * 9/2016 Orne, III ..... F41A 17/38
2017/0160026 A1 * 6/2017 Walther ..... F41A 3/68
2017/0198999 A1 * 7/2017 Goddard ..... F41A 3/66
2017/0241729 A1 * 8/2017 Gangl ..... F41A 17/36
2017/0284761 A1 * 10/2017 Lewis ..... F41A 17/36
2017/0299303 A1 * 10/2017 Phipps ..... F41A 17/36
2018/0073827 A1 * 3/2018 Blakey ..... F41A 17/38
2018/0100714 A1 * 4/2018 Borders ..... F41A 3/72
2018/0112942 A1 * 4/2018 Iwasawa ..... F41B 11/56
2018/0149438 A1 * 5/2018 Headrick ..... F41A 9/65
2018/0172374 A1 * 6/2018 Lupher ..... F41A 3/68
2018/0238648 A1 * 8/2018 Delgado Acarreta ..... F41A 9/53
2018/0259282 A1 * 9/2018 Tolentino ..... F41A 9/70
2019/0093978 A1 * 3/2019 Maugham ..... F41A 17/36
2019/0137202 A1 * 5/2019 Facchini ..... F41A 3/72
2019/0212081 A1 * 7/2019 Cox ..... F41C 7/02
2020/0109904 A1 * 4/2020 Daniel ..... F41A 3/66
2020/0158460 A1 * 5/2020 Dextraze ..... F41C 27/00

* cited by examiner

BOLT STOP ASSEMBLIES

CROSS-REFERENCE TO RELATED APPLICATIONS

The present application claims priority to and the benefit of U.S. Provisional Patent Application No. 62/743,316, filed Oct. 9, 2018, which is hereby incorporated by reference in its entirety.

FIELD OF THE DISCLOSURE

The disclosure generally relates to bolt stops for bolt action firearms.

BACKGROUND

Bolt action firearms are unique weapons consisting of a bolt coupled to an operating handle that is cycled within the firearm's receiver when a user manually advances/retracts and rotates the bolt. When the user manually advances the bolt, the bolt pushes a round (consisting of a projectile and casing) towards the bolt action firearm's chamber and then, after the projectile is discharged, the user manually retracts the bolt rearward towards an ejection port to extrude the spent casing. Generally, the bolt moves longitudinally within the receiver to load rounds and unload casings. In some instances, the bolt action firearm has a bolt stop to prevent the bolt from unintentionally being completely removed from the bolt action firearm receiver by the user. Typically, bolt stops protrude from the side of a bolt action firearm receiver and are attached with a pin perpendicular to the longitudinal axis of the bore and the receiver. Additionally, conventional bolt stops can easily snag on objects and be difficult to operate when inserting or removing the bolt from the receiver.

Accordingly, there remains a need for improving the profile of bolt stops as well as improving the methods of operation for inserting and removing the bolt from the bolt action firearm's receiver.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which the use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
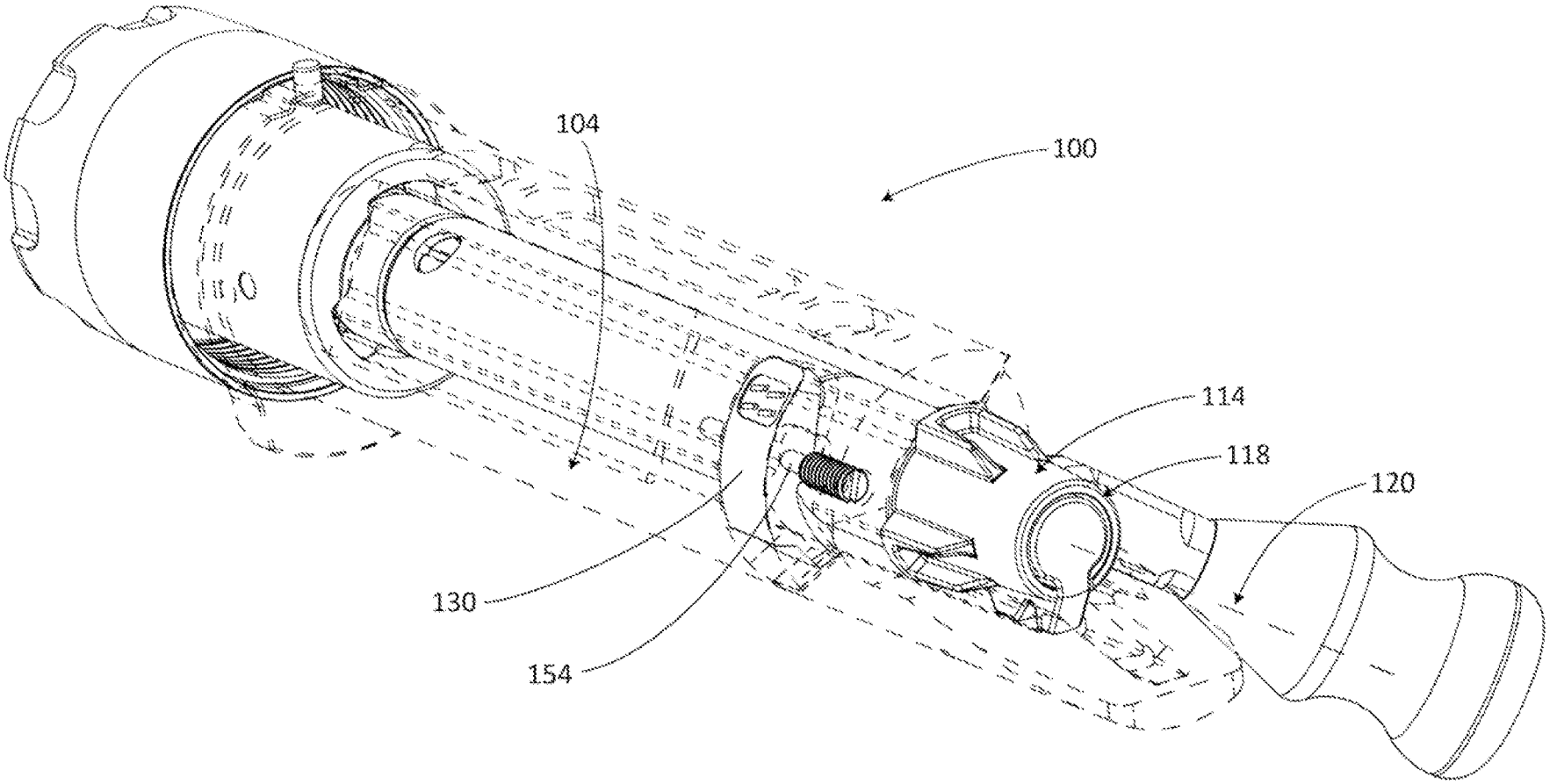
FIG. 1 is perspective partial x-ray cross-sectional view of a bolt stop assembly according to one or more embodiments of the disclosure.

The present disclosure provides for an actuating bolt stop disposed within a receiver aperture to rotate about a pivot pin fixated on a longitudinal axis substantially parallel to both the longitudinal axis of the bore and the receiver of a bolt action firearm. In this manner, the forces applied to the bolt stop upon a manual bolt cycle may not cause a shearing force to be applied to a pivot pin. That is, as described herein, most of the forces passing from the bolt to the bolt stop are then passed on to the receiver, also referred to as the action, at the interface between the bolt stop and the receiver. One benefit to a pivot pin in parallel alignment with the receiver about which the bolt stop rotates may be to significantly increase the strength of the bolt stop assembly by almost completely removing one possible failure point, that is, a bolt stop pivot pin placed in a latitudinally (e.g., perpendicular) relationship to the receiver. For example, if the pivot pin were to be disposed latitudinally, the pivot pin may encounter shear force from the bolt contacting the bolt stop.

Further, the present disclosure provides for a bolt stop configured to sit flush with the exterior of the receiver. For example, the exterior surface of the bolt stop (e.g., the surface exposed to the environment outside the receiver) may be aligned with the exterior surface of the receiver, following to the shape of the exterior surface of the receiver at the position of the bolt stop. One benefit of a flush surface between the bolt stop and the receiver may include that the bolt stop may not be accidentally activated. A second benefit may include that no other object may get caught or snagged on the bolt stop.

In some embodiments, a bolt stop assembly may include an actuating bolt stop, a bolt having a series of lugs, and a bolt handle operatively connected to the bolt disposed in a receiver. In this manner, the bolt stop assembly may be configured to stop the bolt on a user's rearward stroke towards the butt of a bolt action firearm during a manually operated bolt cycle. That is, as the bolt is manually rotated and retracted back towards the butt of the bolt action firearm to eject the spent casing (i.e., one-half of the bolt cycle), the series of lugs passes the ejector port of the receiver, and the bolt stop may be configured to contact at least one lug to stop the rearward movement of the bolt to prevent the bolt from being removed from the receiver.

In some embodiments, the bolt stop may rest in a biased position under a spring load so that a portion of the bolt stop engages at least one lug of the bolt to prevent the bolt from leaving the receiver. For example, the bolt stop may rotate between a closed position (e.g., under load of a bolt stop spring in an extended position) and an open position (e.g., in an actuated position whereby the bolt stop pivots or rotates to prevent engagement with any of the lugs of the bolt as the bolt moves rearward). As previously mentioned, the bolt stop may be in the closed position where the bolt stop may be partially disposed within the interior of the receiver and configured to contact or engage the bolt (e.g., one or more lugs of the bolt). In an open position, the bolt stop may be rotated about the pivot pin so that the portion of the bolt stop that contacts the bolt is rotated or pivoted out of the path of the bolt (e.g., one or more lugs of the bolt). In the open position, the bolt may then slide completely out of the receiver and thus the bolt action firearm. The bolt can be re-inserted and secured back into the bolt action firearm in two ways: (i) in the open position; and (2) in the closed position. In the open position, a user aligns and inserts the series of lugs into the channels within the receiver and slides the bolt into the receiver. The series of lugs may be slid past the open bolt stop, with the bolt stop being held in the open position, and then the user can cease actuating the bolt stop so that it returns to the closed position, thereby securing the bolt within the receiver. Alternatively, in the closed position, a user aligns and inserts the series of lugs into the channels within the receiver and slides the bolt into the receiver. The series of lugs may be slid into contact with the bolt stop, which is in the closed position, and as a lug (or lugs) contacts the bolt stop, it contacts a chamfered surface of the bolt stop. The bolt stop may be configured to rotate or pivot into the open position from the closed position as the at least one lug slides along the chamfered surface of the bolt stop, overcoming the biased closed position. Once the series of lugs has passed the bolt stop, the bolt stop may then return to the closed position under the biased load of the bolt stop springs—thus, securing the bolt within the bolt action firearm.

Bolt Stop Assembly

In some embodiments, as depicted in FIGS. 1-5, a bolt stop assembly 100 is provided. The bolt stop assembly 100 includes a bolt action firearm with a receiver 104, a bolt 114, an operating bolt handle (not shown) and an actuating bolt stop 130. The bolt stop assembly 100, and more specifically, the actuating bolt stop 130 is configured to work in tandem with the receiver 104 to secure the bolt 114 within the receiver 104. For example, as discussed herein, the actuating bolt stop 130 may include a closed position 150 (e.g., as shown in FIG. 3A). That is, the actuating bolt stop 130 may be operably rotated within the interior of the receiver 104 (e.g., within a channel 106 of the receiver 104). In some instances, as the bolt 114 slides within the receiver 104, the actuating bolt stop 130 in the closed position 150 may engage one of the series of lugs 122, thereby preventing the bolt 114 from being removed from the receiver 104 (e.g., as shown in FIG. 3A). Further, the actuating bolt stop 130 may be manually rotated into an open position 151 (e.g., as shown in FIG. 3B). In the open position 151, the actuating bolt stop 130 may not prevent the bolt 114 from exiting the receiver 104 and being removed from the bolt action firearm. That is, in the open position 151, the bolt 114 may slide past the actuating bolt stop 130 out of the receiver 104. One benefit of the bolt stop assembly 100 may include providing a user with an operable and easy way to ensure that the bolt 114 is secured within the receiver 104 of a bolt action firearm.

Figure 2:
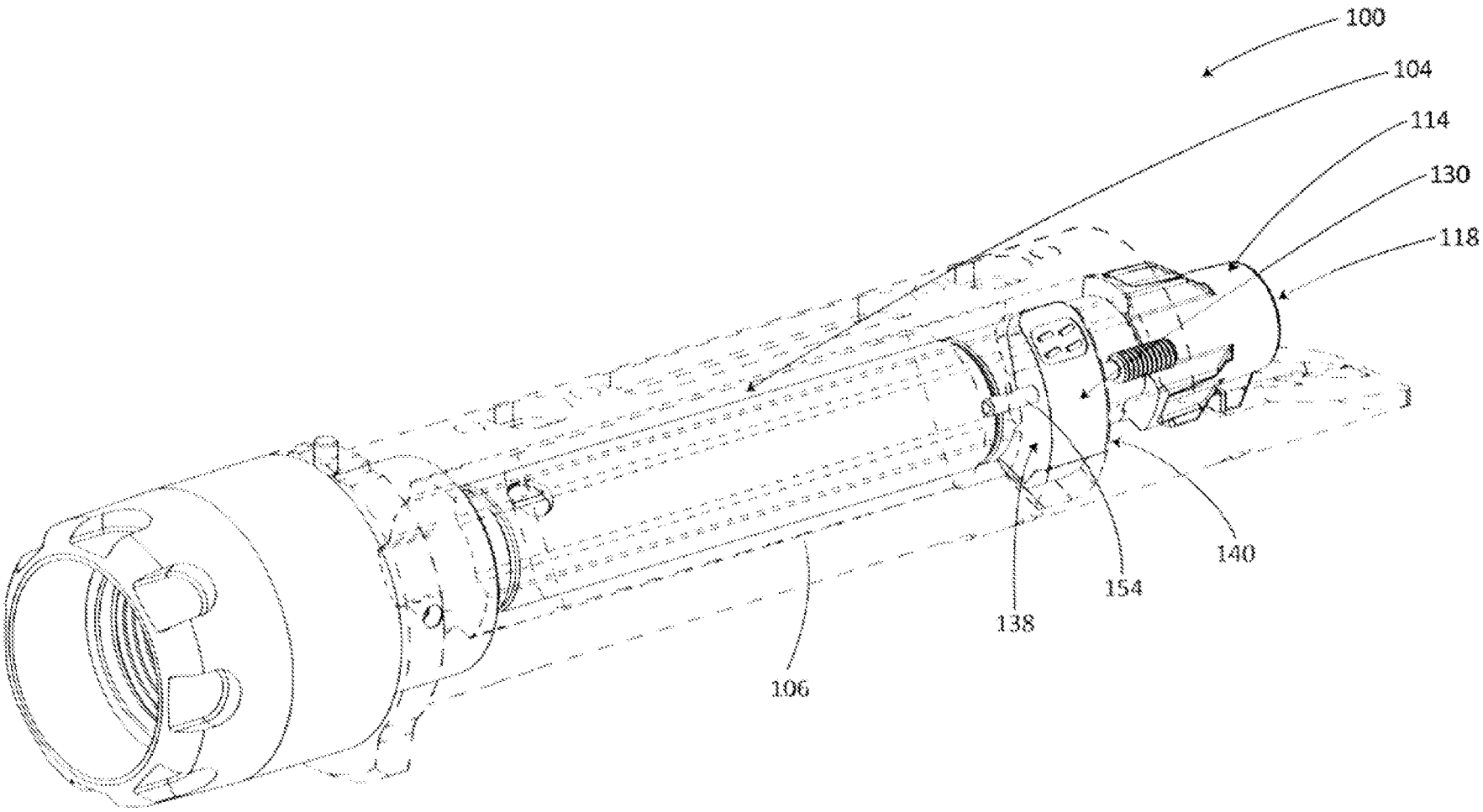
FIG. 2 is a second perspective partial x-ray cross-sectional view of the bolt stop assembly according to one or more embodiments of the disclosure.

In some embodiments, as shown in FIGS. 1-3B, the receiver 104 may include a breech end 108 and a muzzle end (not shown). The internal volume of the receiver 104 extends between the breech end 108 and the muzzle end. For instance, a longitudinal axis 120 provides for the internal path of the receiver 104 volume. The receiver 104 is a housing for a substantial portion of the bolt 114. As depicted in FIG. 2, the receiver 104 provides for a plurality of channels 106. The channels 106 extend longitudinally parallel to the longitudinal axis 120 and are configured to receive a series of lugs 122 on the bolt 114. In some instances, the cross-sectional area of the plurality of channels 106 complement the shape of the series of lugs 122. That is, as the bolt 114 and the series of lugs 122 go through a manual bolt cycle, the plurality of channels 106 may provide a path through the receiver 104 to travel from the muzzle end of the receiver 104 to the breech end 108 of the receiver 104. The plurality of channels 106 may be rectangular cross-sections. In other instances, the plurality of channels 106 may be another shape, such as square, semicircular, or triangular. Additionally, as discussed herein, when in the closed position 150, at least a portion of the actuating bolt stop 130 may extend into the plurality of channels 106 to prevent the bolt 114 from sliding along the plurality of channels 106.

Figure 4A:
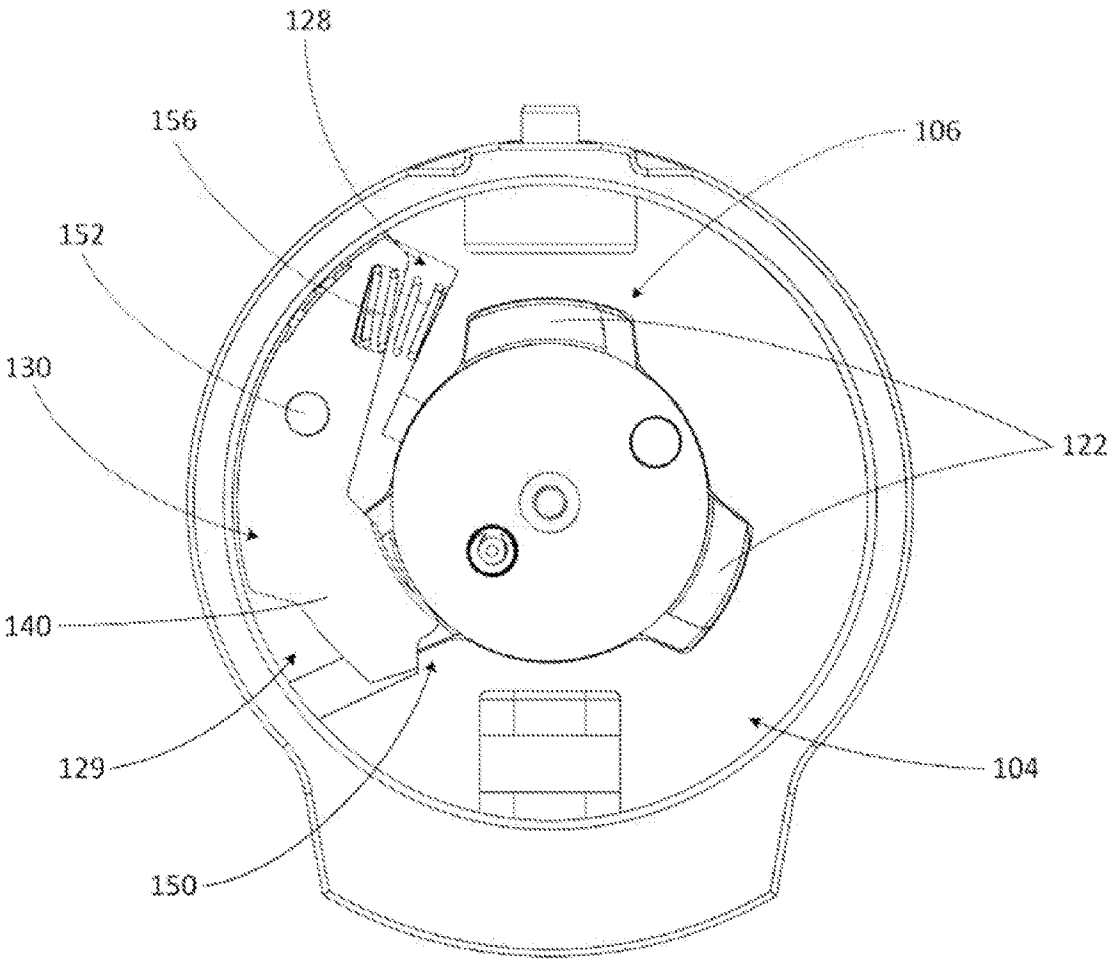
FIG. 4A is a cross-sectional view of the series of lugs, the actuating bolt stop, and a receiver in a closed position according to one or more embodiments of the disclosure.
Figure 4B:
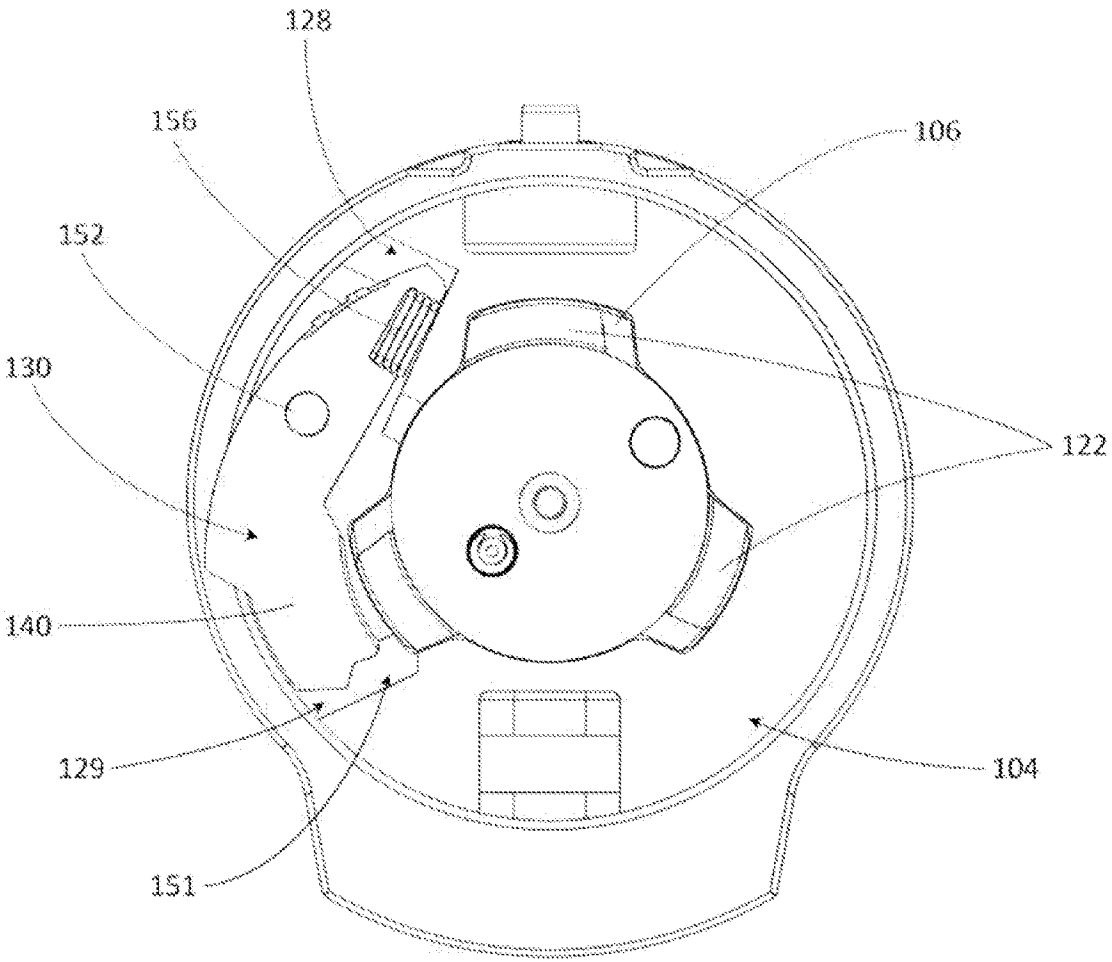
FIG. 4B is a cross-sectional view of the series of lugs, the actuating bolt stop, and a receiver in an open position according to one or more embodiments of the disclosure.
Figure 5:
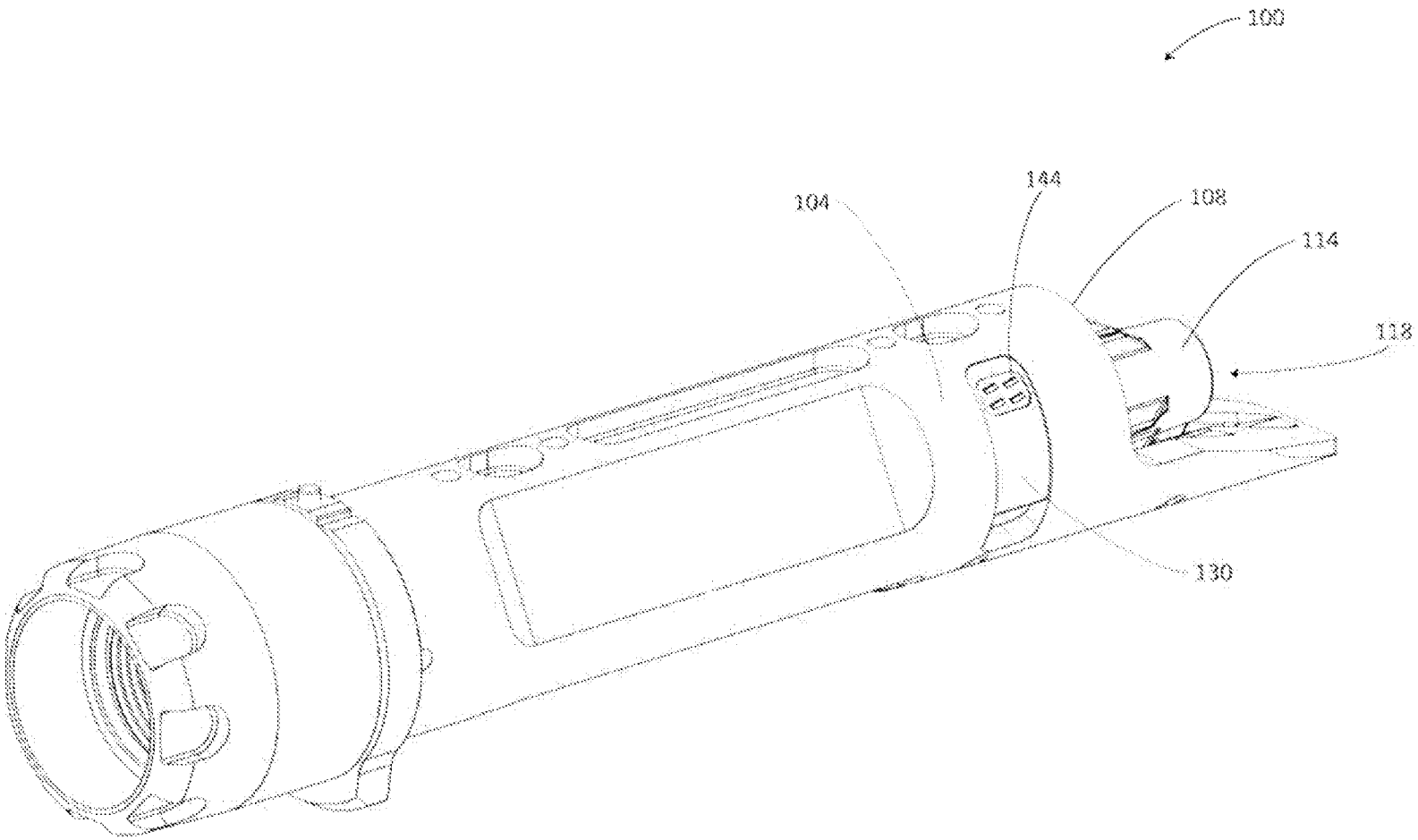
FIG. 5 is a perspective view of the actuating bolt stop assembly according to one or more embodiments of the disclosure.
Figure 6:
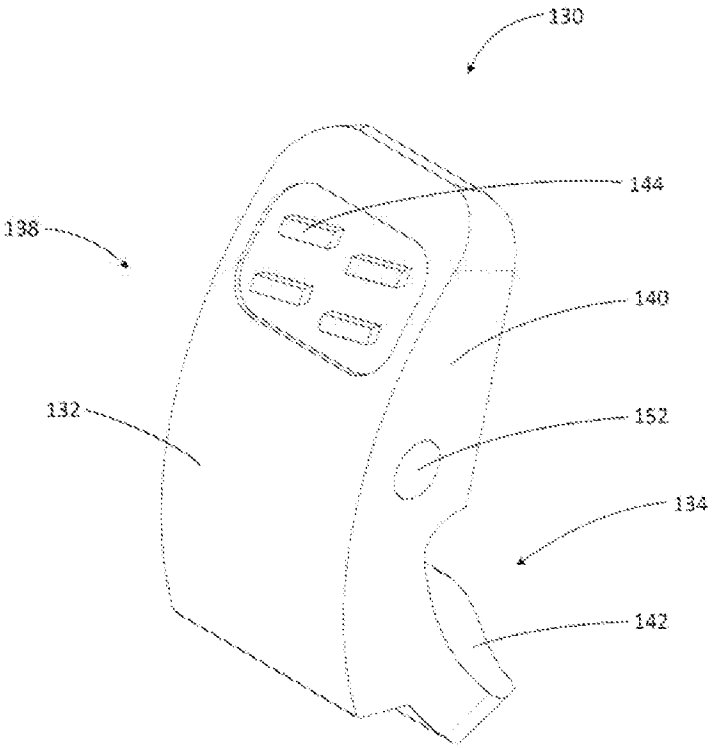
FIG. 6 is an exterior rear view of the actuating bolt stop according to one or more embodiments of the disclosure.

In some embodiments, as depicted in FIGS. 4A and 4B, a cross-sectional view of the series of lugs 122, the actuating bolt stop 130, and a receiver 104 is shown. The receiver 104 may include an aperture 128 configured to complement the shape of the actuating bolt stop 130. For example, the aperture 128 may be a rectangular cross-section formed in the receiver 104 to receive the actuating bolt stop 130. The aperture 128 may be configured to give partial access to the interior of the receiver 104 (e.g., into the plurality of channels 106). For example, the aperture 128 may be formed in the receiver 104. The aperture 128 may partially be carved within the receiver 104 to create a cavity, and the aperture 128 may partially be open to the internal volume of the receiver 104. In some instances, the aperture 128 provides support for the actuating bolt stop 130 as forces are applied to the varying surfaces of the actuating bolt stop 130. For example, a biasing member 156 (e.g., a compression spring, torsion spring, a extension spring) may be disposed within the aperture 128 and configured to rotate the actuating bolt stop 130 about the pin hole 152. The aperture 128 may provide a path for the actuating bolt stop 130 moves within when rotating about a pivot pin 154 disposed parallel to the longitudinal axis 120. In other instances, the sidewalls of the aperture 128 may counteract against any forces acting on the bolt stop 130 in the direction of the longitudinal axis 120. One particular force acting on the actuating bolt stop 130 and the sidewalls of the aperture 128 may include a force from the movement of the bolt 114. Specifically, a force from the interaction of the actuating bolt stop 130 and the series of lugs 122. The actuating bolt stop 130 can be in the closed position 150 (e.g., as shown in FIG. 4A) or in the open position 151 (e.g., as shown in FIG. 4B), and the force may act upon the actuating bolt stop 130 in the closed position 150.

In some embodiments, as shown in FIGS. 1-3B, the bolt 114 with a bolt handle operatively coupled thereto (not shown), is configured to allow a user to manually advance the bolt to put a round into the chamber of a barrel, and once the round is fired the user can retract the bolt to expel a spent round casing through an ejector port (not shown) on the receiver 104. The bolt 114 may be a cylinder coupled to the series of lugs 122, where the bolt 114 and the series of lugs 122 are disposed within the receiver 104. In some instances, the bolt 114 includes a distal end 116 and a proximate end 118 extending along the longitudinal axis 120. The series of lugs 122 may be coupled to the distal end 116 of the bolt 114. A bolt handle coupled to the bolt 114 may be configured for a user to manually cycle the bolt 114 through the receiver 104 to unload a spent casing and reload a new round for discharging from the bolt action firearm. For example, the bolt 114 may start from a rearward position (i.e., retracted towards the butt of the bolt action firearm). From the magazine (not shown) coupled to the bolt action firearm's chassis (not shown) and through receiver 104, a round may protrude into the path of the bolt 114. The bolt 114 may be guided by the plurality of channels 106 within the receiver 104. As the bolt 114 is manually advanced towards the muzzle end of the receiver 104, the bolt 114 catches the protruding round and advances the round into the chamber. The bolt 114 may then be manually turned within the receiver 104 once the series of lugs 122 enters the chamber at the muzzle end of the receiver 104. The manual rotation may lock the bolt 114 into place, and the firing pin may then be ready to strike the primer of the round. After the projectile is fired, a user may manually rotate and retract the bolt handle coupled to the bolt 114 to unload the spent casing. For example, the user may manually rotate the bolt 114 via the bolt handle to unlock and rotate the series of lugs 122 back to the plurality of channels 106. The bolt 114 may then be manually retracted to the first rearward position as the series of lugs 122 are guided along the plurality of channels 106. The spent casing may then expel from the ejector port, and the cycling process may start again. In some instances, the actuating bolt stop 130 discussed herein may prevent the bolt from exiting the receiver 104 as the bolt approaches the butt of the bolt action firearm. For example, the actuating bolt stop 130 may contact one or more of the series of lugs 122 and may act as an obstacle within one or more of the plurality of channels 106 to prevent removal of the bolt. When a user activates the bolt stop into the open position 151, the bolt stop will no longer obstruct the path of the lugs and the bolt 114 may then be manually withdrawn from the receiver 104. Thereafter, the bolt 114 may be reinserted into the receiver 104 after disengaging from the receiver 104. For example, the distal end 116 of the bolt 114 may be placed within the receiver 104 and the series of lugs 122 may align with the plurality of channels 106. In the open position 151, the bolt 114 may be manually slid back into the receiver 104 and be secured once the actuating bolt stop 130 is actuated to the closed position. In the closed position, as the bolt 114 travels within the receiver 104, the second surface 126 of the series of lugs 122 may contact a chamfered surface 142 of the actuating bolt stop 130. The second surface 126 of the series of lugs 122 may engage and slide along the chamfered surface 142 of the bolt stop, pushing or forcing the bolt stop 130 to rotate about pivot pin 154, thereby allowing the bolt to pass the bolt stop 130. In some instances, the actuating bolt stop 130 may rotate back into the closed position under the force of the biasing member 156 once the series of lugs 122 passes the actuating bolt stop 130 within the plurality of channels 106. That is, the actuating bolt stop 130 rotates back into place and provides a temporary obstacle for the bolt 114 from being removed from within the receiver 104.

Figure 3A:
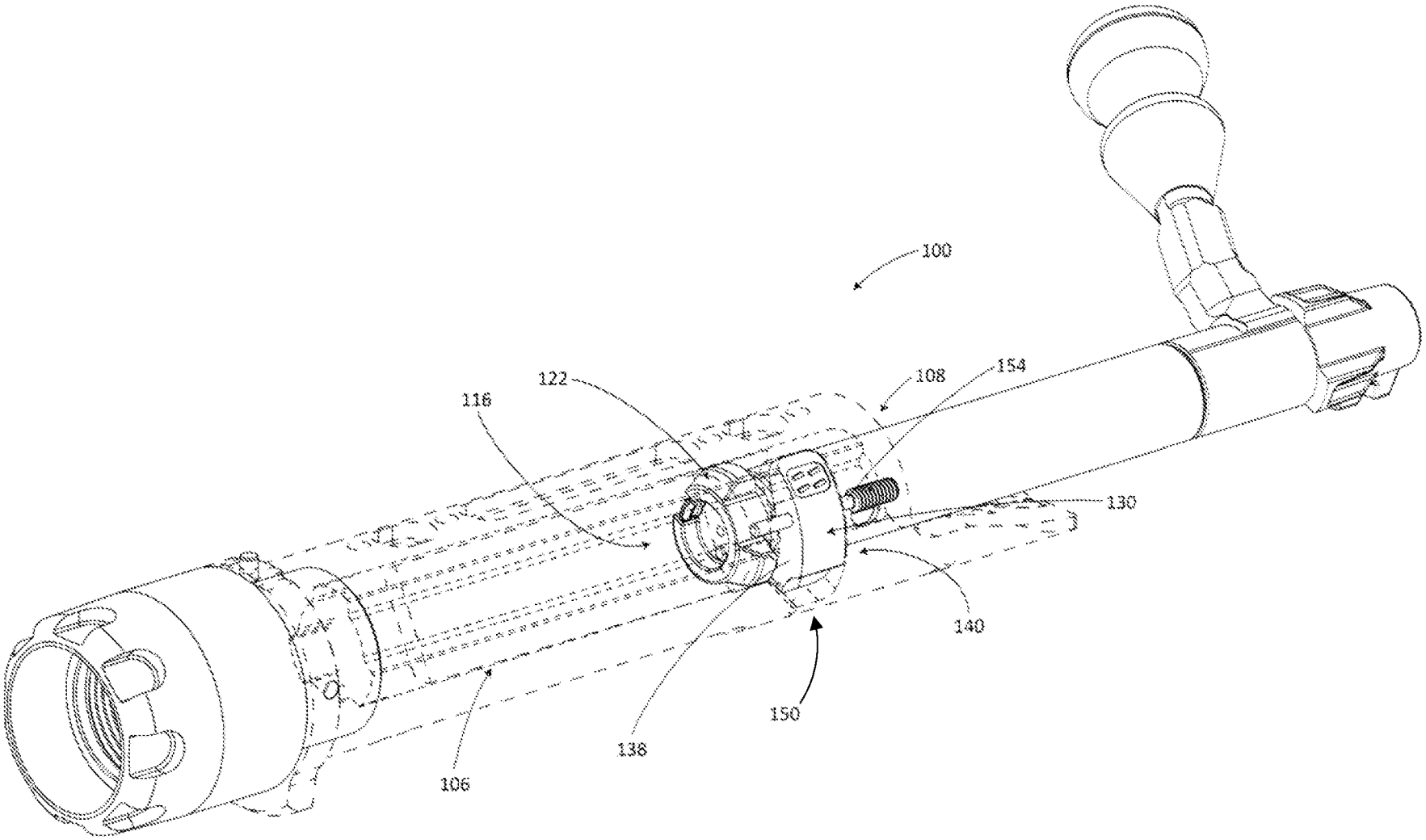
FIG. 3A is a perspective partial x-ray cross-sectional view of the actuating bolt stop and a series of lugs coupled to a bolt in a closed position according to one or more embodiments of the disclosure.
Figure 12A:
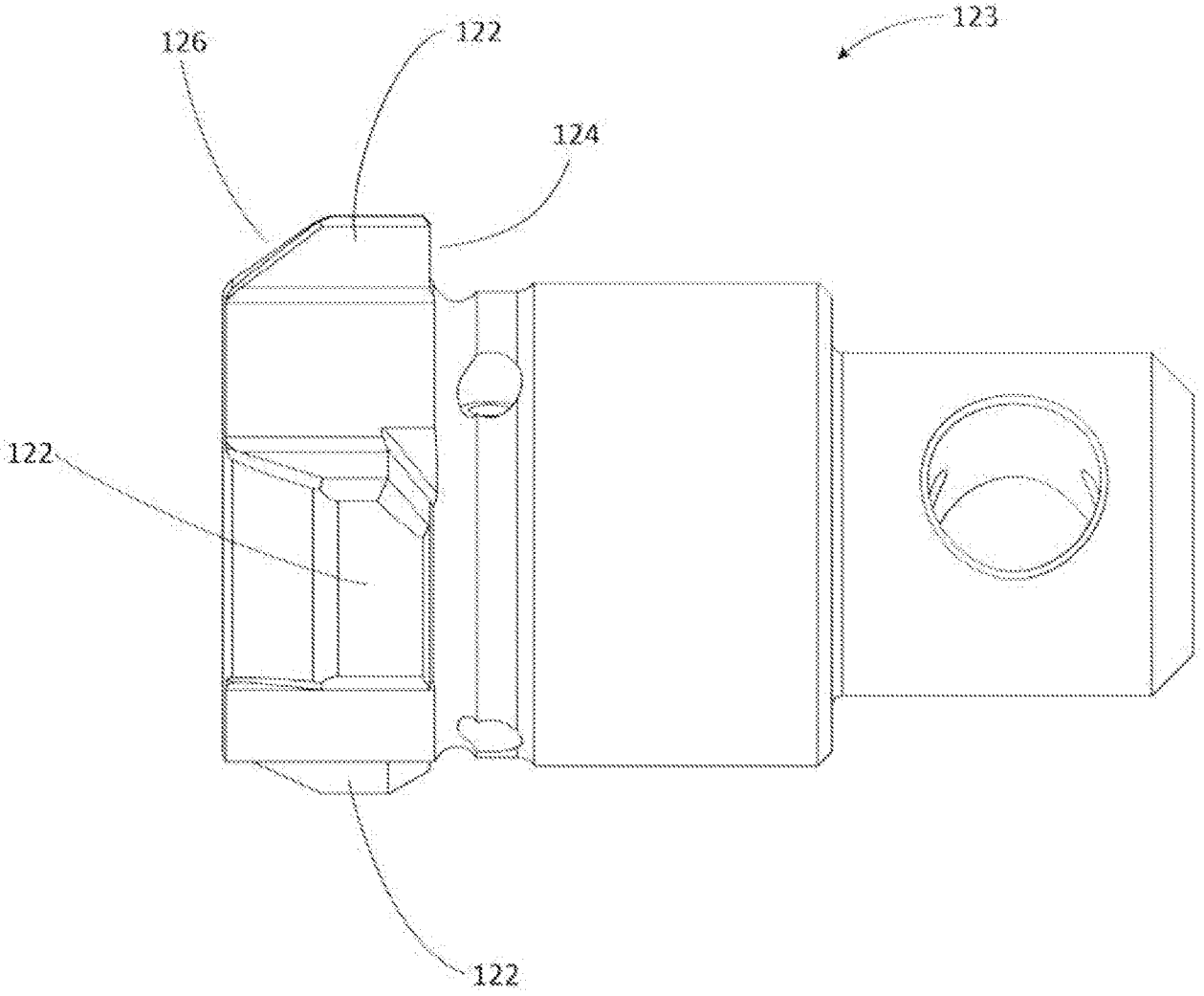
FIG. 12A is a side view of a bolt head having a series of lugs according to one or more embodiments of the disclosure.
Figure 12B:
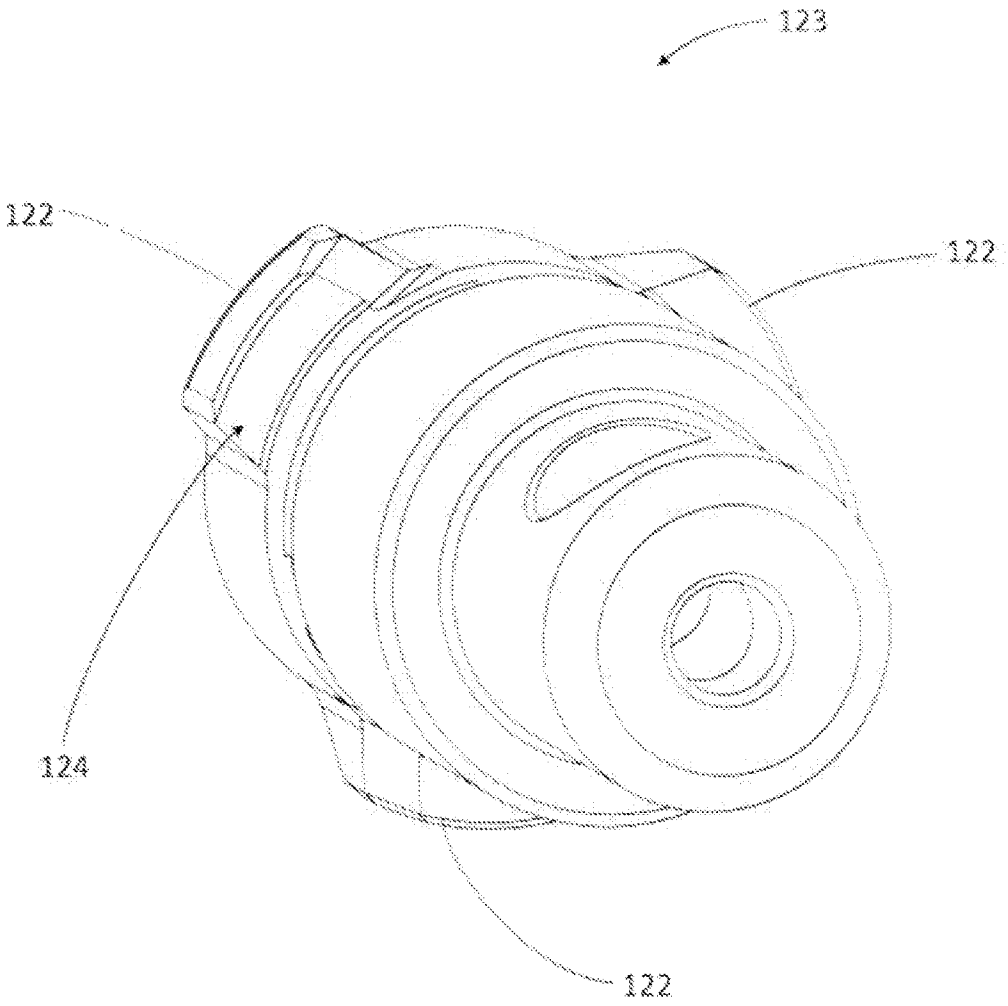
FIG. 12B is a rear perspective view of a bolt head having the series of lugs according to one or more embodiments of the disclosure.

In some embodiments, as depicted in FIGS. 3A-4B and 12A-12B, the bolt 114 is coupled to an actuating bolt head 123 having a series of lugs 122. In some instances, the series of lugs 122 is configured to traverse the plurality of channels 106 within the receiver 104. For example, the series of lugs 122 may be rectangular protrusions from the bolt 114 configured to complement the plurality of channels 106 within the receiver 104. In other instances, the series of lugs 122 may be square, semi-circular, or triangular. As depicted in FIGS. 12A-12B, the series of lugs 122 are disposed on the bolt head 123, operatively connected to the bolt 114. The series of lugs 122 are each disposed 120 degrees from each other. In other instances, the series of lugs 122 may be disposed more or less than 120 degrees from each lug on the bolt 114. The series of lugs 122 may include a first surface 124 configured to contact the forward surface 138 (e.g., as depicted in FIGS. 1-3) of the actuating bolt stop 130. In some instances, the contact between the forward surface 138 and the series of lugs 122 may prevent the bolt 114 from being removed from the receiver 104. The first surface 124 may be perpendicular to the surface of the bolt 114. In other instances, the first surface 124 may be at a different angle from the surface of the bolt 114. The series of lugs 122 may include a second surface 126 configured to contact the aft surface 140 and the chamfered surface 142 of the actuating bolt stop 130. That is, the second surface 126 may be disposed towards the distal end 116 of the bolt 114, opposite the first surface 124 of the series of lugs 122. For example, as previously discussed, the second surface 126 may be configured to contact the chamfered surface 142 of the actuating bolt stop 130.

Actuating Bolt Stop

In some embodiments, as depicted in FIGS. 5-11, the actuating bolt stop 130 includes an exterior surface 132 and an opposed interior surface 134. For example, the exterior surface 132 may be disposed on the exterior of the bolt action firearm, and more specifically, on the exterior surface of the receiver 104. Conversely, the actuating bolt stop 130 may include an opposed interior surface 134 to the exterior surface 132 that is disposed on the interior of the bolt action firearm. That is, the opposed interior surface 134 may be exposed within the interior of the receiver 104. Each surface may interact with the user and the bolt 114 to secure or disengage the bolt 114 from within the receiver 104. For example, the exterior surface 132 may include a textured surface 144. The textured surface 144 may signal a location on the actuating bolt stop 130 for a user to apply force for operation. In some instances, the textured surface 144 may include a series of shaped protrusions. In other instances, the textured surface 144 may be knurling, a series of indented surfaces, ridges, or some other surface. The exterior surface 132 around the textured surface 144 may be smooth and level. In some embodiments, the exterior surface 132 of the actuating bolt stop 130 is flush with the external surface of the receiver 104. That is, the curvature of the receiver 104 is matched by the curvature of the exterior surface 132 of the actuating bolt stop 130. As previously discussed, one benefit of a exterior surface 132 flush with the receiver 104 may include anticipating and preventing possible snags on other objects by the actuating bolt stop 130.

Figure 3B:
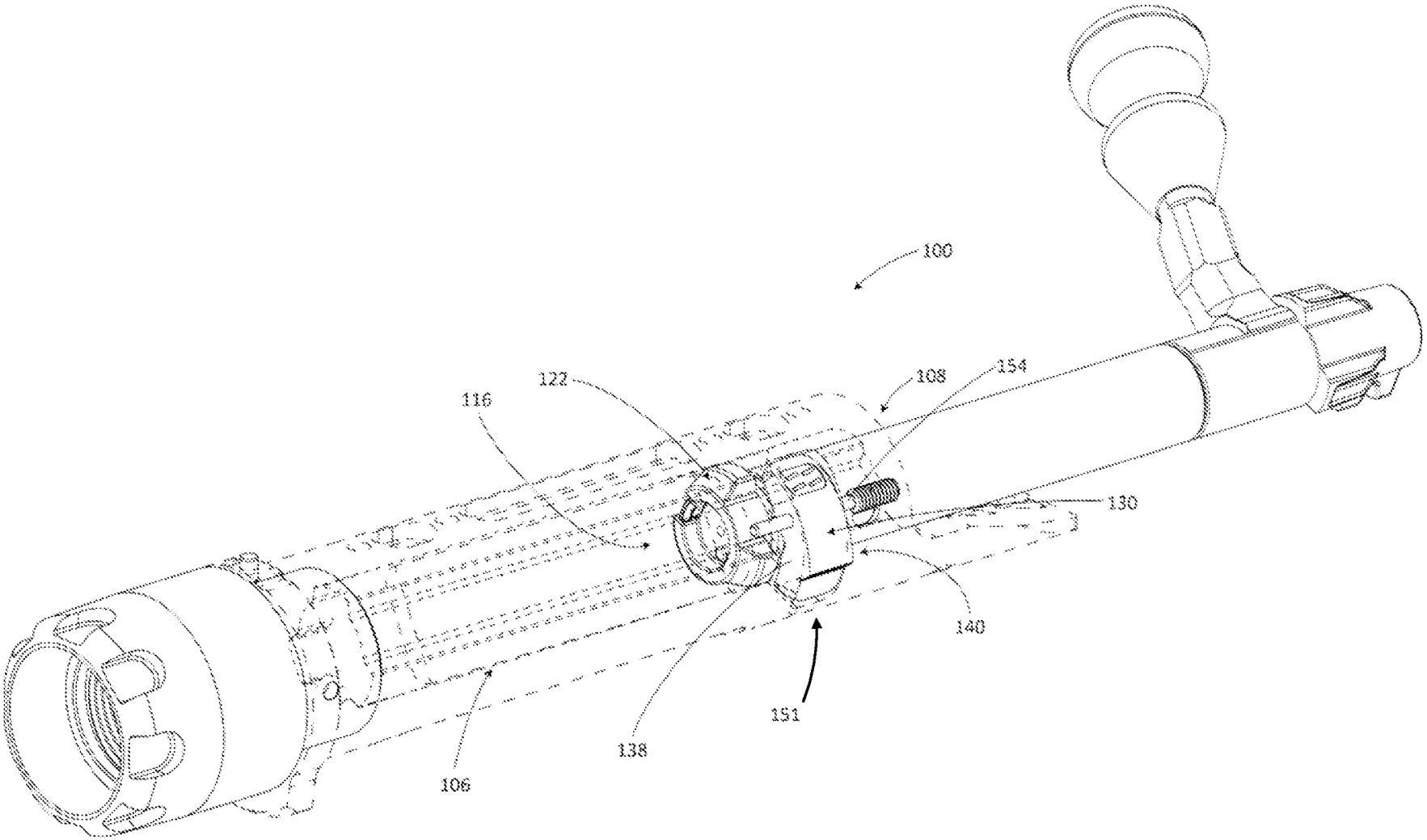
FIG. 3B is a perspective partial x-ray cross-sectional view of the actuating bolt stop and a series of lugs coupled to a bolt in an open position according to one or more embodiments of the disclosure.

In some embodiments, the actuating bolt stop 130 includes a plurality of side surfaces. The plurality of side surfaces may include a forward surface 138 and an aft surface 140, among others. As shown in FIGS. 3A-3B, the forward surface 138 is disposed towards the muzzle end (not shown) of the receiver 104 and the aft surface 140 is disposed towards the breech end 108 of the receiver 104. In other instances, the forward surface 138 and the aft surface 140 may be disposed in a plurality of other directions within the receiver 104. As discussed herein, the forward surface 138 may be configured to contact the series of lugs 122 to prevent the bolt 114 from sliding from the receiver 104. In some instances, the forward surface 138 may be a flat surface configured to be partially disposed within the plurality of channels 106 of the receiver 104. In other instances, the forward surface 138 may have a textured, ridged, or some other complementary surface to the series of lugs 122. On the opposite side of the forward surface 138, may be the aft surface 140 of the actuating bolt stop 130. The aft surface 140, opposed from the forward surface 138, may be configured to contact the series of lugs 122 when the bolt 114 is being manually inserted into the receiver 104. For example, the aft surface 140, along with the interior surface 134, may include a chamfered surface 142. The chamfered surface 142 may be an angled surface configured to contact the series of lugs 122. In other instances, the chamfered surface 142 may be a curved surface. The chamfered surface 142 may complement a second surface 126 (e.g., as shown in FIG. 12A) of the series of lugs 122. As the second surface 126 of the series of lugs 122 contacts the chamfered surface 142, the interaction may rotate the actuating bolt stop 130 from within the receiver 104. That is, the actuating bolt stop 130 may not be an obstacle to the bolt 114 as the bolt 114 is manually pushed from the aft surface 140 towards the forward surface 138 of the actuating bolt stop 130.

Figure 7:
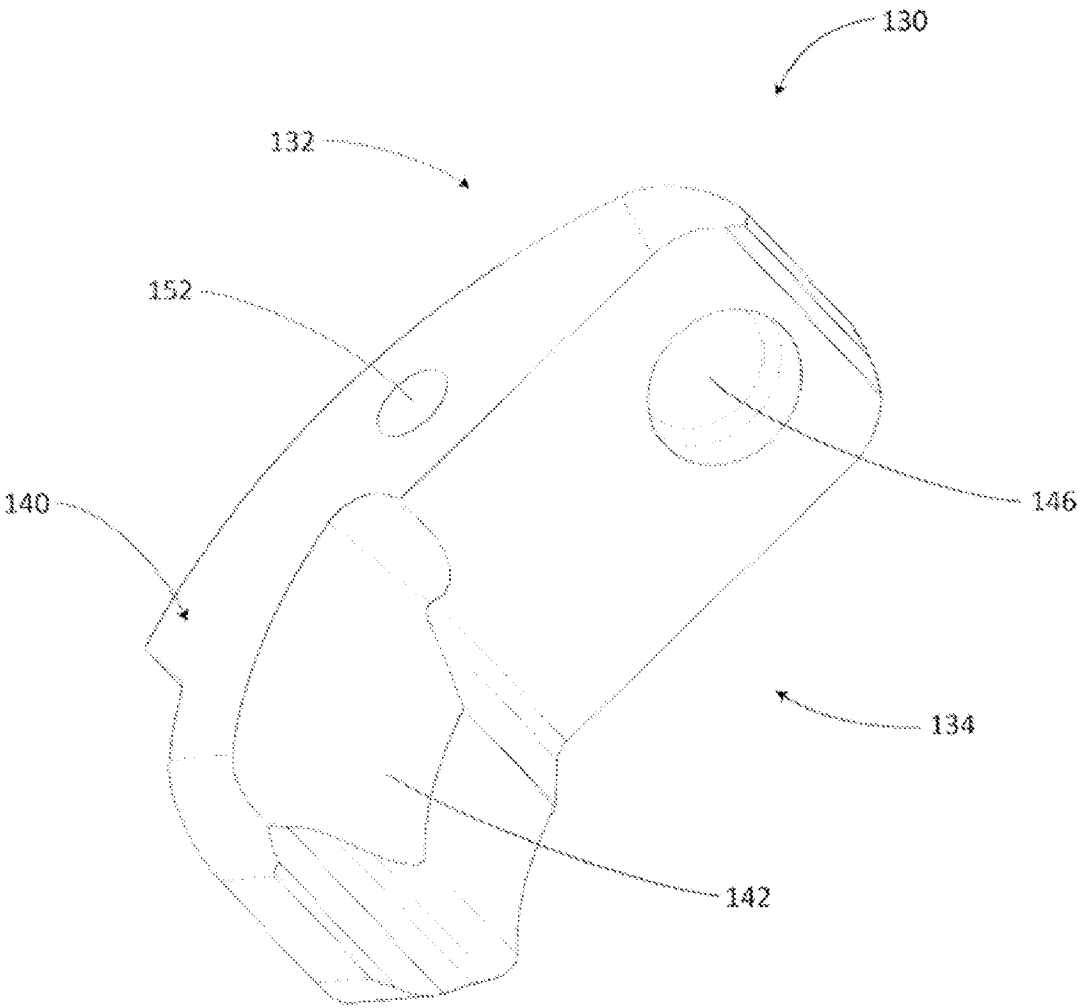
FIG. 7 is an interior rear view of the actuating bolt stop according to one or more embodiments of the disclosure.
Figure 8:
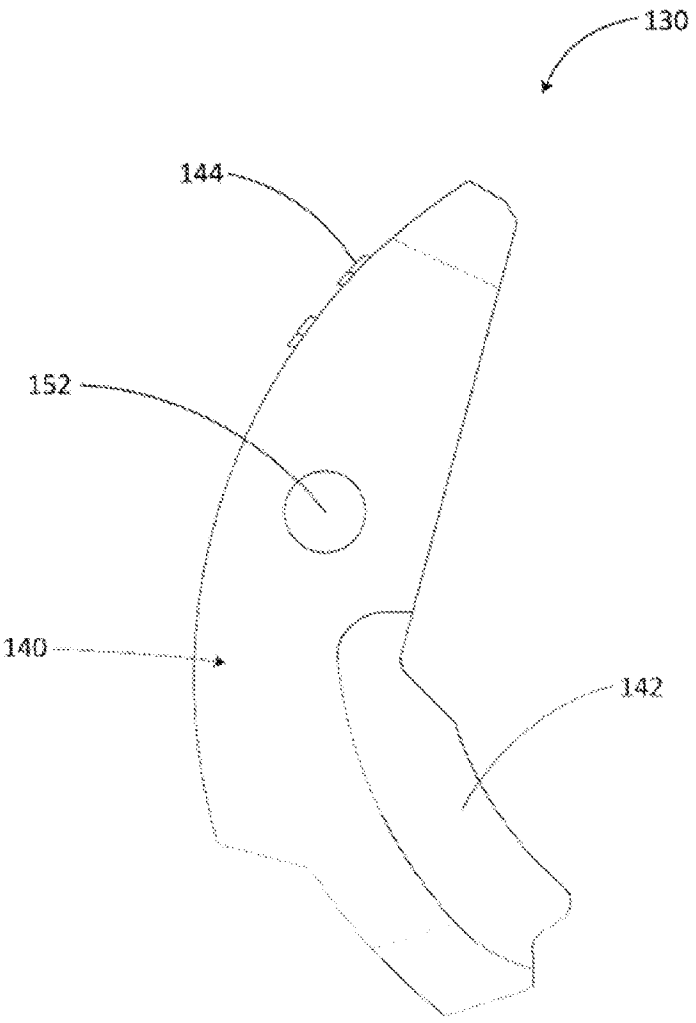
FIG. 8 is a rear view of the actuating bolt stop according to one or more embodiments of the disclosure.
Figure 9:
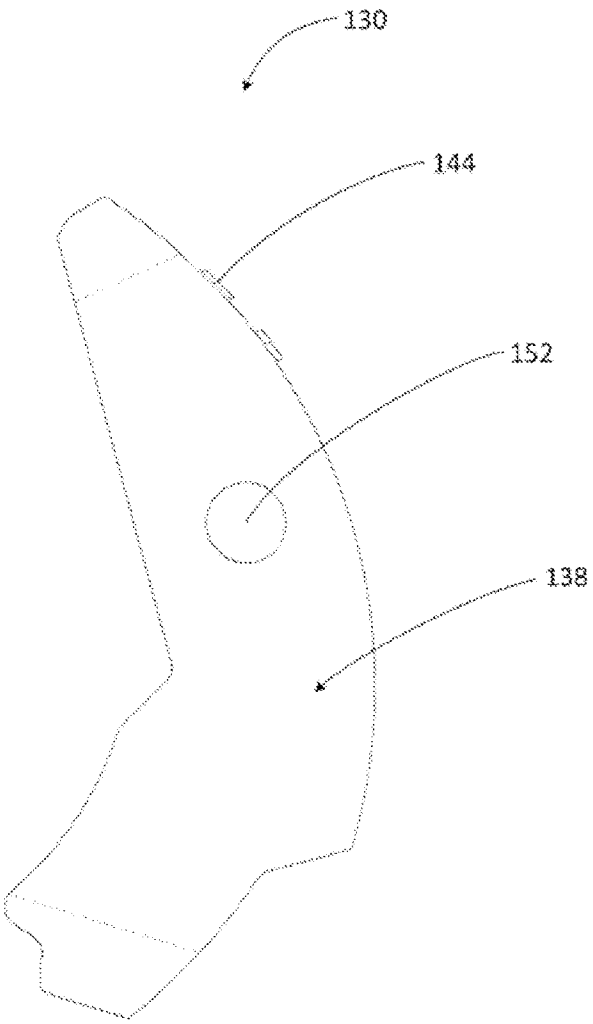
FIG. 9 is a front view of the actuating bolt stop according to one or more embodiments of the disclosure.
Figure 10:
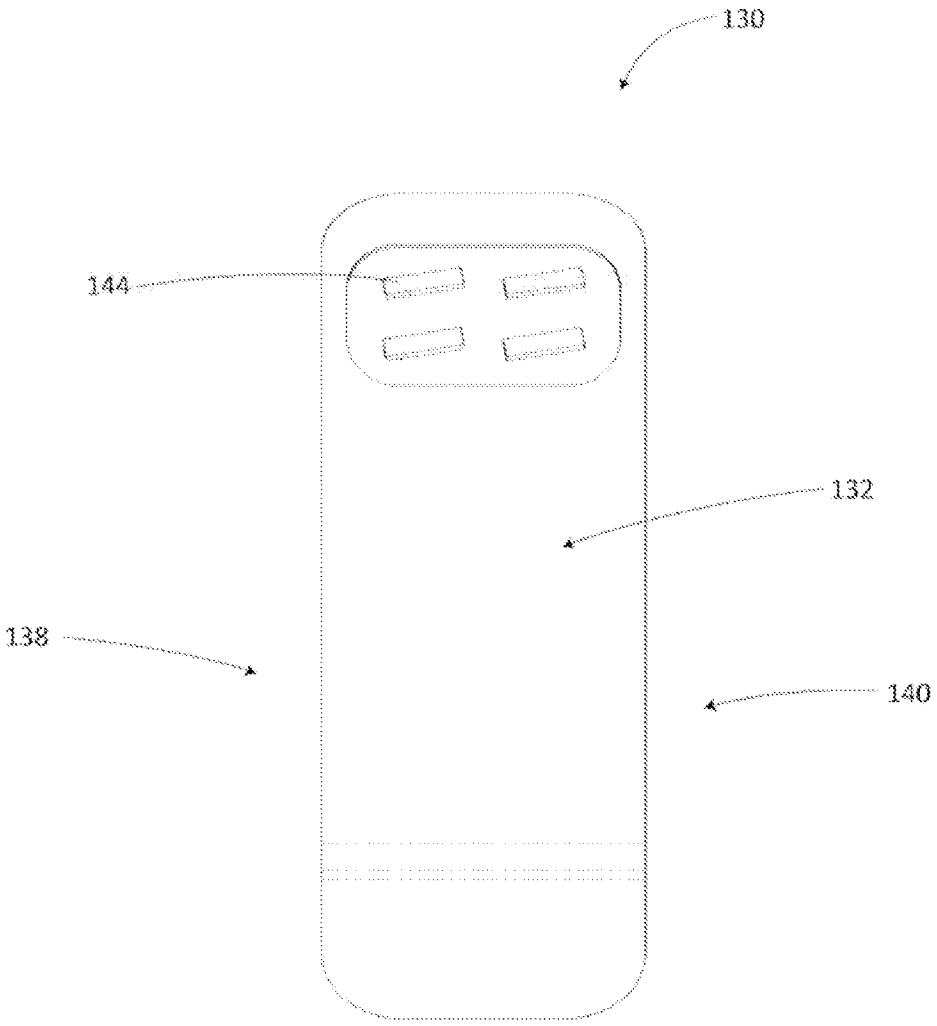
FIG. 10 is an exterior view of the actuating bolt stop according to one or more embodiments of the disclosure.
Figure 11:
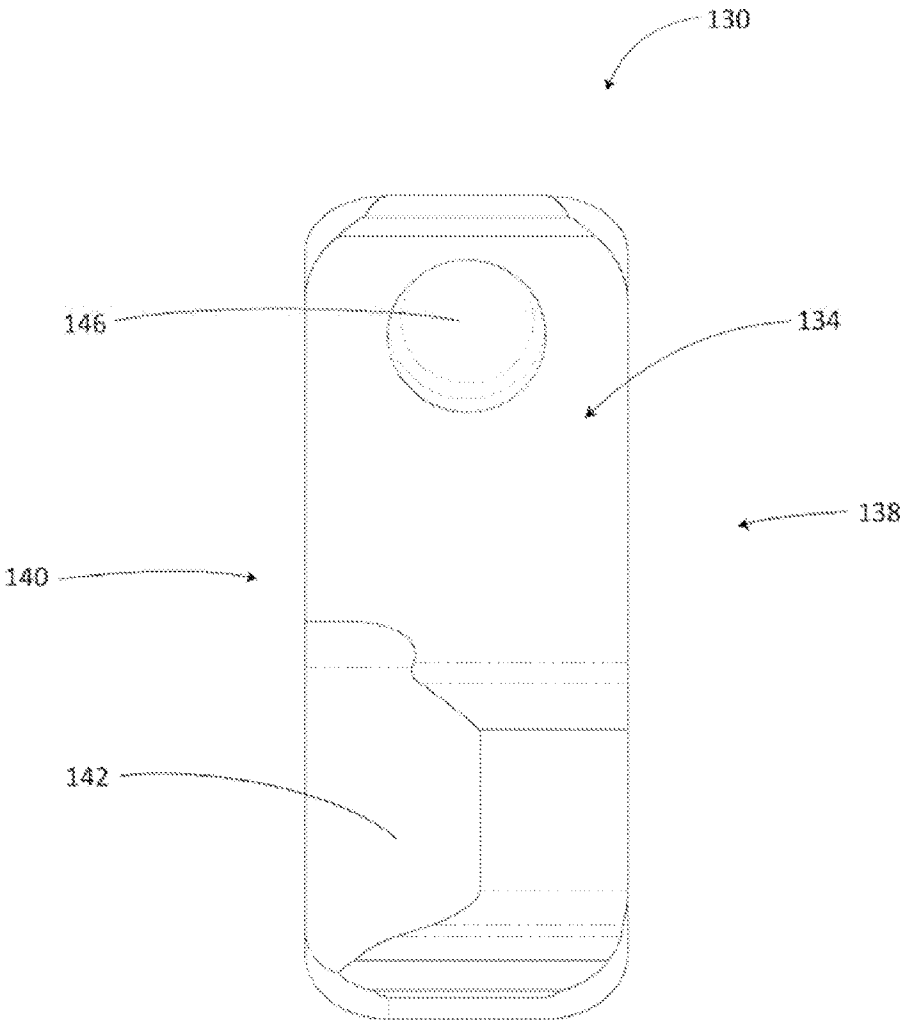
FIG. 11 is an interior view of the actuating bolt stop according to one or more embodiments of the disclosure.

In some embodiments, as depicted in FIG. 7, the interior surface 134 includes an indented surface 146. In some instances, the indented surface 146 is a rounded indention in the interior surface 134 of the actuating bolt stop 130 configured to receive a biasing member 156 (e.g., as shown in FIG. 4A-4B). In other instances, the indented surface 146 may be another shaped indention or include a fastener to secure the biasing member 156 against the actuating bolt stop 130. As discussed herein, the biasing member 156 may apply force against the indented surface 146 to rotate the actuating bolt stop 130 about a pivot pin 154.

In some embodiments, the pin hole 152 is configured to receive the pivot pin 154 (as shown in FIGS. 1-3B). For example, the pin hole 152 may align with an aperture on the receiver 104, and the pivot pin 154 may be threaded within the aperture and through the pin hole 152. Pivot pin 154 may alternatively be a coil spring pin or some other pin of a similar ilk. In some instances, the pin hole 152 may be cylindrical. In other instances, the pin hole 152 may be rectangular, square, triangular, or some other shaped cross-section. In some embodiments, the actuating bolt stop 130 may rotate about the pin hole 152. For example, the pin hole 152 may be disposed in a parallel direction as the longitudinal axis 120 (e.g., as shown in FIG. 1). The pivot pin 154 may be embedded within the pin hole 152 along a parallel axis to the longitudinal axis 120 and the actuating bolt stop 130 may rotate about the pin hole's offset axis. One benefit of the direction in which the pin hole 152 is disposed may include avoiding high shear stresses on the pivot pin 154. That is, a force acts substantially on the actuating bolt stop 130 once the series of lugs 122 applies force to the forward surface 138 or the aft surface 140 of the actuating bolt stop 130. For example, as the series of lugs 122 applies force to the forward surface 138 of the actuating bolt stop 130, the aft surface 140 may react to the applied force by contacting the side of the receiver 104. The interaction between the plurality of side surfaces of the actuating bolt stop 130 and the receiver 104, therefore, may relieve the shear forces on the pivot pin 154. That is, in some instances, no shear, normal, or other force may act on the pivot pin 154. In this manner, the force from the series of lugs 122 may act on the actuating bolt stop 130, and the actuating bolt stop 130 may then act on the receiver 104.

In some embodiments, the actuating bolt stop 130 is at least partially disposed within the aperture 128 of the receiver 104 and configured to manually rotate between an open position 151 and a closed position 150. Each position may be configured to secure or allow the series of lugs 122 disposed on the bolt 114 to move or not move past the actuating bolt stop 130. For example, in a closed position 150 the actuating bolt stop 130 may be partially disposed within at least one of the plurality of channels 106 within the receiver 104. That is, at least the forward surface 138 of the actuating bolt stop 130 may be disposed within the plurality of channels 106. In the closed position 150, the actuating bolt stop 130 may prevent any further rearward movement of the series of lugs 122 past the actuating bolt stop 130 along the plurality of channels 106. Conversely, the actuating bolt stop 130 may include an open position 151 configured to allow further movement of the series of lugs 122 within the plurality of channels 106 of the receiver 104 for removal of bolt 114. For example, the actuating bolt stop 130 may rotate about the pivot pin 154, against a biasing member 156 disposed within the indented surface 146 of the interior surface 134. In some instances, the rotation of the actuating bolt stop 130 may remove the actuating bolt stop 130 from being an obstacle for the series of lugs 122 within the plurality of channels 106. The biasing member 156 may be configured to apply a constant force to the actuating bolt stop 130 to rotate the actuating bolt stop 130 back to the closed position 150 from the open position 151. For example, the biasing member 156 may be a spring disposed within the aperture 128 of the receiver 104 and against the indented surface 146 of the actuating bolt stop 130. The biasing member 156 may be disposed against the indented surface 146. In other instances, the biasing member 156 may be disposed against any surface of the actuating bolt stop 130. For example, the actuating bolt stop 130 may be disposed within a second aperture 129 on one side of the actuating bolt stop 130 to rotate the actuating bolt stop 130 between an open position 151 and a closed position 150. The biasing member 156 may be a plurality of other springs, fasteners, or mechanisms that apply a constant force (e.g., tension spring, rubber, etc.). For example, the biasing member 156 may be a torsion spring within the pin hole 152 configured to rotate the actuating bolt stop 130 between an open position 151 and a closed position 150.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A bolt stop assembly, comprising:

a receiver comprising a plurality of channels extending longitudinally to a firearm barrel;

a bolt having a proximate end and a distal end;

a series of lugs coupled to the distal end of the bolt, wherein the series of lugs are configured to traverse the plurality of channels;

an aperture adjacent to a breech end of the receiver;

an actuating bolt stop set within the aperture, the actuating bolt stop comprising an exterior surface, an opposed interior surface, and a plurality of side surfaces;

a pin hole configured to accept a pivot pin, wherein the pivot pin is set parallel to a longitudinal axis, wherein the longitudinal axis extends from the distal end of the bolt to the proximate end of the bolt, and wherein the actuating bolt stop rotates about the pivot pin; and a biasing member disposed between the opposed interior surface and the receiver, wherein the plurality of side surfaces comprising a forward surface and an aft surface, wherein the forward surface is disposed towards a muzzle end of the receiver and the aft surface is disposed towards the breech end of the receiver, and wherein the forward surface is configured to contact at least one of the series of lugs to prevent at least one of the series of lugs from sliding out of the receiver.

2. The bolt stop assembly of claim 1, wherein the actuating bolt stop comprises an open position and a closed position, wherein the closed position is configured to prevent at least one of the series of lugs from sliding out of the receiver.

3. The bolt stop assembly of claim 2, wherein the plurality of side surfaces comprises a chamfered surface extending between the opposed interior surface and the aft surface.

4. The bolt stop assembly of claim 3, wherein the series of lugs comprising:

a first surface configured to contact the forward surface of the actuating bolt stop in the closed position; and a second surface configured to contact the chamfered surface of the actuating bolt stop in the closed position.

5. The bolt stop assembly of claim 4, wherein at least one of the series of lugs is configured to rotate the actuating bolt stop as the bolt slides from the aft surface towards the forward surface of the actuating bolt stop.

6. The bolt stop assembly of claim 5, wherein the biasing member comprises a compression spring, wherein the biasing member is configured to rotate the actuating bolt stop to a closed position.

7. The bolt stop assembly of claim 5, wherein the exterior surface of the actuating bolt stop comprises a textured surface.

8. The bolt stop assembly of claim 5, wherein the exterior surface of the actuating bolt stop is flush with an external surface of the receiver.

9. The bolt stop assembly of claim 5, wherein the longitudinal axis extends from the distal end of the bolt to the proximate end of the bolt.

10. The bolt stop assembly of claim 5, wherein the series of lugs comprises three lugs each disposed 120 degrees about a center of the bolt.

11. The bolt stop assembly of claim 5, wherein the actuating bolt stop comprises an indented surface disposed on the opposed interior surface, wherein the indented surface is configured to receive the biasing member.

12. An assembly, comprising:

a receiver;

a bolt disposed within the receiver;

an aperture through the receiver;

an actuating bolt stop at least partially disposed within the aperture;

a pivot pin extending through the actuating bolt stop, wherein the pivot pin is parallel to a longitudinal axis of the bolt, wherein the longitudinal axis extends from a distal end of the bolt to a proximate end of the bolt, wherein the actuating bolt stop rotates about the pivot pin between a first position and a second position, wherein the actuating bolt stop is configured to prevent removal of the bolt in a rearward direction from the receiver when in the first position, and wherein the actuating bolt stop is configured to enable removal of the bolt in the rearward direction from the receiver when in the second position; and a biasing member disposed about the actuating bolt stop and configured to bias the actuating bolt stop in the first position.

* * * * *